United States Patent [19]

Nakano et al.

[11] 4,084,760

[45] Apr. 18, 1978

[54] TRANSFERRING YARN IN AN AUTOMATIC WINDER

[75] Inventors: Tatsuya Nakano, Ichinomiya; Kazuyoshi Yasuda, Nagoya; Takeshi Miwa, Obu, all of Japan

[73] Assignee: Mitsubishi Jukogyo Kabushiki Kaisha, Tokyo, Japan

[21] Appl. No.: 723,905

[22] Filed: Sep. 16, 1976

[30] Foreign Application Priority Data

Sep. 25, 1975 Japan ..... 50-114919

[51] Int. Cl.[2] ..... B65H 67/04; B65H 54/34

[52] U.S. Cl. ..... 242/18 A; 242/18 PW; 242/43 R

[58] Field of Search ..... 242/18 A, 18 PW, 43 R, 242/25 A

[56] References Cited

U.S. PATENT DOCUMENTS

| | | | |
|---|---|---|---|
| 3,520,483 | 7/1970 | Swallow | 242/18 PW |
| 3,741,488 | 6/1973 | Wuest | 242/18 PW |
| 3,907,217 | 9/1975 | Graf et al. | 242/18 PW |
| 3,908,917 | 9/1975 | Tschentscher | 242/18 PW |
| 3,921,923 | 11/1975 | Kuno et al. | 242/18 A |

*Primary Examiner*—Stanley N. Gilreath

*Attorney, Agent, or Firm*—Cushman, Darby & Cushman

[57] ABSTRACT

Ways and means are described for transferring yarn in a turret type, surface drive automatic winder wherein the yarn having changed properties caused by inevitable tension variation upon transfer is wound as a waste winding, while loosening of the transfer tail is suppressed to eliminate failure from such a cause during the yarn transfer operation.

2 Claims, 8 Drawing Figures

TRANSFERRING YARN IN AN AUTOMATIC WINDER

BACKGROUND OF THE INVENTION

For transferring a yarn in a surface drive, turret type automatic winder that has been heretofore proposed, bobbins are driven by means of an independent electric motor while a traverse speed is lowered to a speed that is most suitable for forming a transfer tail. A traverse cam roll is shifted by a pneumatic cylinder or other known means so as to bring a yarn in contact with a yarn gripping device provided at an end of an empty bobbin or on an empty bobbin holder and to make the yarn gripping device grip the yarn. A yarn portion between the yarn gripping device and a fully wound bobbin is cut by means of a cutter associated with the yarn gripping device to wind the yarn on the empty bobbin. As soon as a transfer tail is formed, the traverse cam roll is restored to its normal position and simultaneously the traverse speed is accelerated to the speed upon normal winding, and an electric power source for said bobbin driving motor is switched off while urging the empty bobbin to a drive roll, whereby the winding is achieved according to a surface drive system.

According to this prior art method, by employing a reliable and rigid yarn gripping device manufactured carefully, the rate of success in an automatic yarn transfer could be made 100%. However, in the case of a bobbin holder rotating at a high speed exceeding 10,000 rpm or a yarn gripping device associated with such a bobbin, it has been difficult to reliably and rigidly grip a yarn against a large centrifugal force and a large wind pressure. In practice, sometimes it occurred that winding on an empty bobbin after a yarn transfer was acheived by making use of a yarn only momentarily captured by the yarn gripping device or a partly gripped yarn, and in some rare cases there occurred a failure. More particularly, sometimes it occurred that a yarn once captured by the yarn gripping device was made to float up by a centrifugal force or a wind pressure. Tension of the yarn extending from the transfer tail portion to the start winding portion of the bobbin was slackened which caused the yarn to float up and to wind itself around the drive roll, resulting in failure of the transfer. In addition, there was a disadvantage that the transfer tail was loosened as it was pulled by the yarn gripping device when the fully wound bobbin was removed from the winder in the case of an automatic winder having a yarn gripping device provided on a bobbin holder, or when the yarn gripping device was removed from the fully wound bobbin in the case of an automatic winder having a yarn gripping device provided at an end of a bobbin, and thereby great inconvenience was encountered in handling the yarn in subsequent processes. In other words, there was a disadvantage that the transfer tail was not as good a transfer tail as is required in the subsequent processes.

In addition, it has been found that the abovedescribed prior art method for transferring a yarn proposed in the prior art is disadvantageous in view of the problem of yarn quality with respect to critical and delicate yarns such as the partially orientated yarns (POY) which have been developed recently. According to the above-described method, just before and after the transfer operation the yarn is wound in the outermost layer on the fully wound bobbin and in the innermost layer on the empty bobbin, and a trash yarn or a waste yarn is not produced. However, in practice, a partially orientated yarn, which is a delicate yarn, has its physical properties changed by a variable tension that is inevitably generated upon transfer of the yarn. This yarn having changed properties is the yarn portion that has been wound by the winder just before and after the transfer of the yarn. The yarn having changed properties just before the transfer could be removed, if necessary, by paying out the outermost layer of the fully wound bobbin and throwing it away, because it was wound in the outermost layer of the fully wound bobbin. On the other hand, the yarn having changed properties just after the transfer could not be removed, because it was wound just on the empty bobbin as a transfer tail and the innermost layer and a normal yarn is wound thereon. Although it was possible to cut away the transfer tail because it was exposed externally, cutting away the once-formed transfer tail was meaningless, and also the problem of mixing of a changed yarn was not resolved.

SUMMARY OF THE INVENTION

The present invention has been proposed in order to eliminate the above-described disadvantages in the prior art, and it is intended to provide a method for transferring a yarn in an automatic winder wherein a yarn having changed properties caused by an inevitable tension variation upon transfer is wound as a waste winding, and by making use of this waste winding, the loosening of a transfer tail is suppressed to eliminate failure in the yarn transfer operation.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF THE PRESENTLY PREFERRED EMBODIMENT OF THE INVENTION

Figure 1:
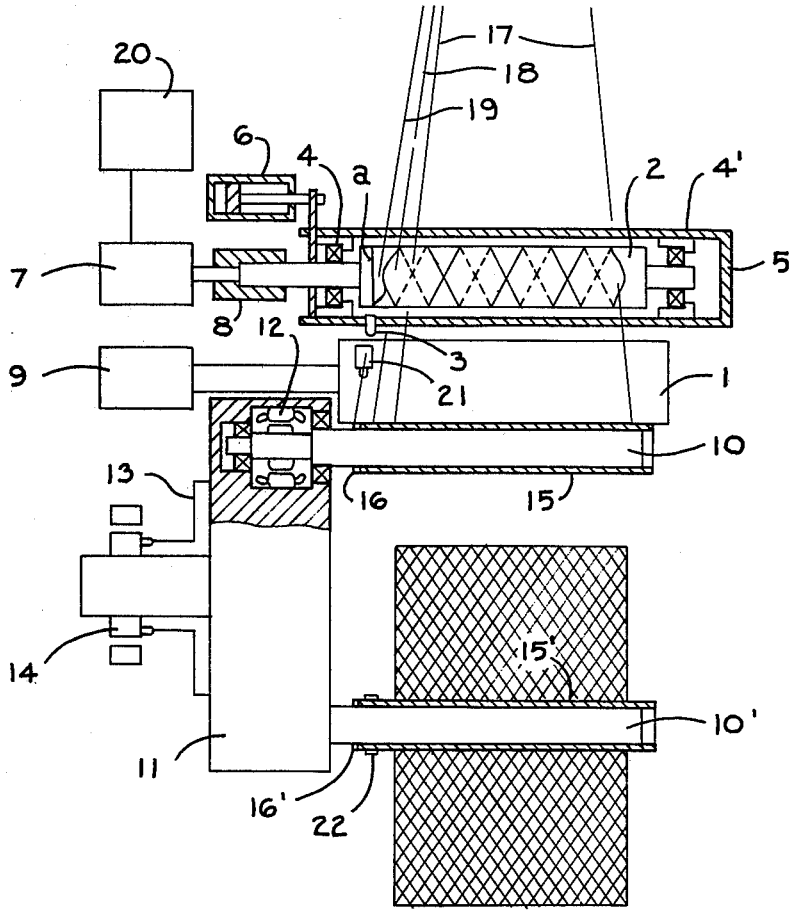
FIG. 1 is an elevation view, with portions in section and parts shown schematically, of a surface driven, turret type automatic winder for yarn, equipped with means for performing the method of the invention.

Now the present invention will be described in connection to the preferred embodiment illustrated in the drawings. In FIG. 1, reference numeral 1 designates a drive roll, numeral 2 designates a traverse cam roll, and numeral 3 designates a traverse guide. Reference numerals 4 and 4' designate bearings for supporting the traverse cam roll 2, which are slidably held in a cam box 5. Reference numeral 6 designates a pneumatic cylinder (having a stroke of about 15 mm) for shifting a traverse cam roll 2, which is connected to the bearing 4. Reference numeral 7 designates an electric motor for driving the traverse cam roll, which is telescopically coupled to the traverse cam roll 2 via coupling means 8. Said drive roll 1 is adapted to be brought in contact with a bobbin by means of an urging device (not shown). Reference numeral 9 designates an electric motor for the drive roll 1, and numerals 10 and 10' designate bobbin holders which are held on a turret arm 11. Reference numeral 12 designates an electric motor contained within the turret arm 11 for accelerating the bobbin, which motor is connected to an external power source (not shown) via wires 13 and slip rings 14. Reference numeral 15 designates an empty bobbin, numeral 15' designates a fully wound bobbin, numerals 16, 16' designate yarn gripping devices provided on the bobbins 15 and 15', respectively, numeral 17 designates a yarn being traversed upon normal winding, numeral 18 designates a yarn when the traverse cam roll 2 is rotated reversely and thereby the traverse guide 3 has been introduced into a fixed groove *a* on the cam roll, numeral 19 designates a yarn when the pneumatic cylinder 6 has been actuated with the traverse guide 3 kept introduced in the fixed groove *a* on the cam roll so as to be brought in contact with the yarn gripping device 16 on the bobbin 15, numeral 20 designates a traverse speed control device, numeral 21 designates a detector for start of winding, and numeral 22 designates a yarn pile wound when the yarn is at the position 18 which forms a bunch winding.

Figure 2:
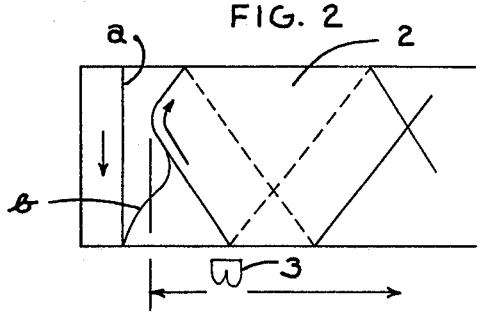
FIGS. 2–5 are fragmentary elevation views on a larger scale of the operational relations between the traverse guide and cam groove of the apparatus of FIG. 1.
Figure 3:
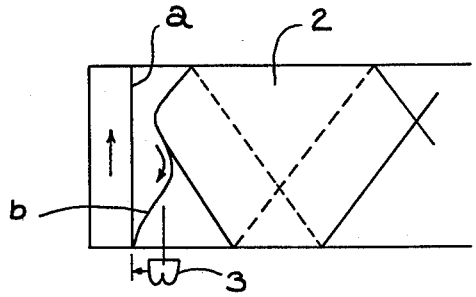

Now the operation of the winder will be described. At first when the take-up bobbin 15' has become fully wound, the electric motor connected to the bobbin holder 10 of the empty bobbin 15 is automatically switched on, and the empty bobbin 15 is accelerated up to such a rotational speed that the peripheral speed of the empty bobbin 15 may be equal to or higher than the linear speed of the yarn being wound on the fully wound bobbin 15'. Then, after the rotational speed has been completely raised to a desired value, the turret arm 11 is rotated to separate the fully wound bobbin 15' from the drive roll 1, and the empty bobbin 15 is displaced to a position just prior to contacting with the drive roll 1. In addition, almost simultaneously with the fully wound bobbin 15' separating from the drive roll 1, the traverse speed control device 20 is actuated to lower the traverse speed to a speed most appropriate for forming a transfer tail (30–100 rpm). Then, the fully wound bobbin 15' is separated from the drive roll 1 and becomes not to be subjected to a drive force, and so, in order to prevent slackening of the yarn, a contained electric motor coupled to the bobbin holder of the fully wound bobbin 15' is switched on simultaneously with rotation of the turret arm 11, to maintain the tension of the yarn. The yarn is traversed at a low speed and wound on the fully wound bobbin 15' while slipping at a high speed along the surface of the rotating empty bobbin 15. Almost simultaneously with the time when the turret 11 has rotated perfectly by 180° and the empty bobbin 15 has come to the winding position, the traverse speed control device 20 feeds a reversely rotating power to the traverse device while maintaining the low speed, so that the traverse guide 3 leaves from the state of moving as guided by the cam groove indicated by a thick line in FIG. 2 to be introduced into the cam groove indicated by a thick line in FIG. 3, and thereby it stops temporarily at the position of the fixed groove *a*. After the traverse guide 3 has stopped in the fixed groove *a*, in response to actuation of a timer (not shown) the pneumatic cylinder 6 operates to displace the traverse cam roll 2 by about 15 mm so that the yarn may come to the position where the yarn makes contact with the yarn gripping device 16 provided at an end of the bobbin.

Figure 4:
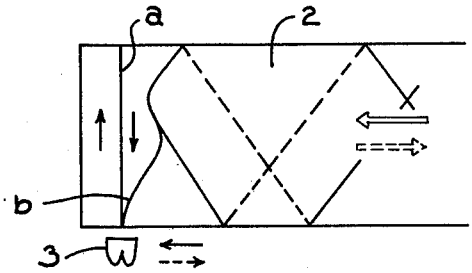
Figure 5:
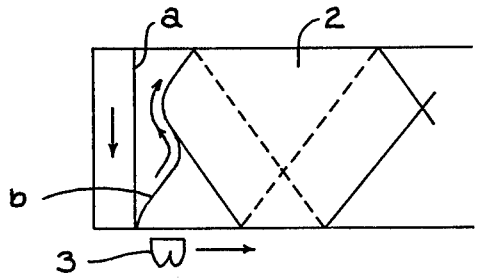

As described, since the yarn 19 traversed onto the yarn gripping device 16 is immediately engaged with the yarn gripping device 16 that is rotating with a relative speed relative to the yarn, the detector for start of winding 21 operates to actuate the pneumatic cylinder 6 to its home position. At this moment, since the traverse cam roll 2 is reversely rotating at a low speed, the traverse guide 3 changes its position in accordance with the movement of the traverse cam roll 2 while continuously stopping at the position of the fixed groove *a* as shown in FIG. 4. More particularly, with reference to FIG. 1 the yarn shifts from the position 18 to the position 19 in accordance with actuation of the pneumatic cylinder 6, and then returns to the position 18 in accordance with restoring operation of the pneumatic cylinder 6. On the other hand, the detector for start of winding 21 makes the pneumatic cylinder 6 operate and causes a timer (not shown) for switching the traverse speed control device 20 to a forward rotation state to start in response to its actuation, so that simultaneously with time-out of this timer the traverse cam roll 2 is switched to forward rotation while maintaining the low speed, and thus the traverse guide 3 is disengaged from the fixed groove *a* as shown in FIG. 5 to be introduced into a normal traverse groove. Accordingly, the yarn pile or bunch winding shown at 22 is formed by winding such amount of yarn that corresponds to the period from the restoring operation of the pneumatic cylinder to the time-out of the timer, at the position of the yarn 18. In accordance with the low speed forward rotation of the traverse cam roll 2, the yarn is traversed at a low speed to be displaced from the position 18 to the position 17 while forming a transfer tail, and then the traverse cam roll 2 is switched to a high speed forward rotation so that normal winding may be started on an empty bobbin 15.

Figure 6:
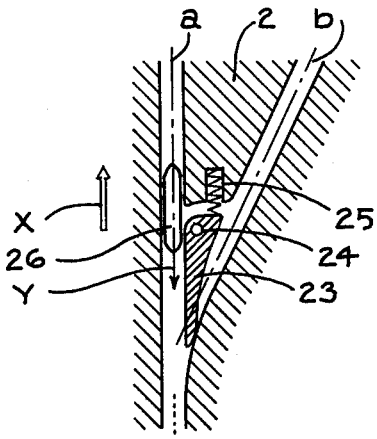
FIGS. 6 and 7 are cross-sectional views on a larger scale of the switching region of the cam groove of FIGS. 2–5.
Figure 7:
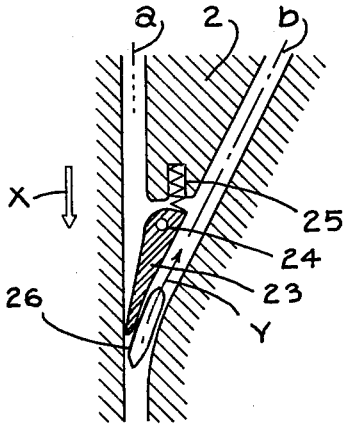
Figure 8:
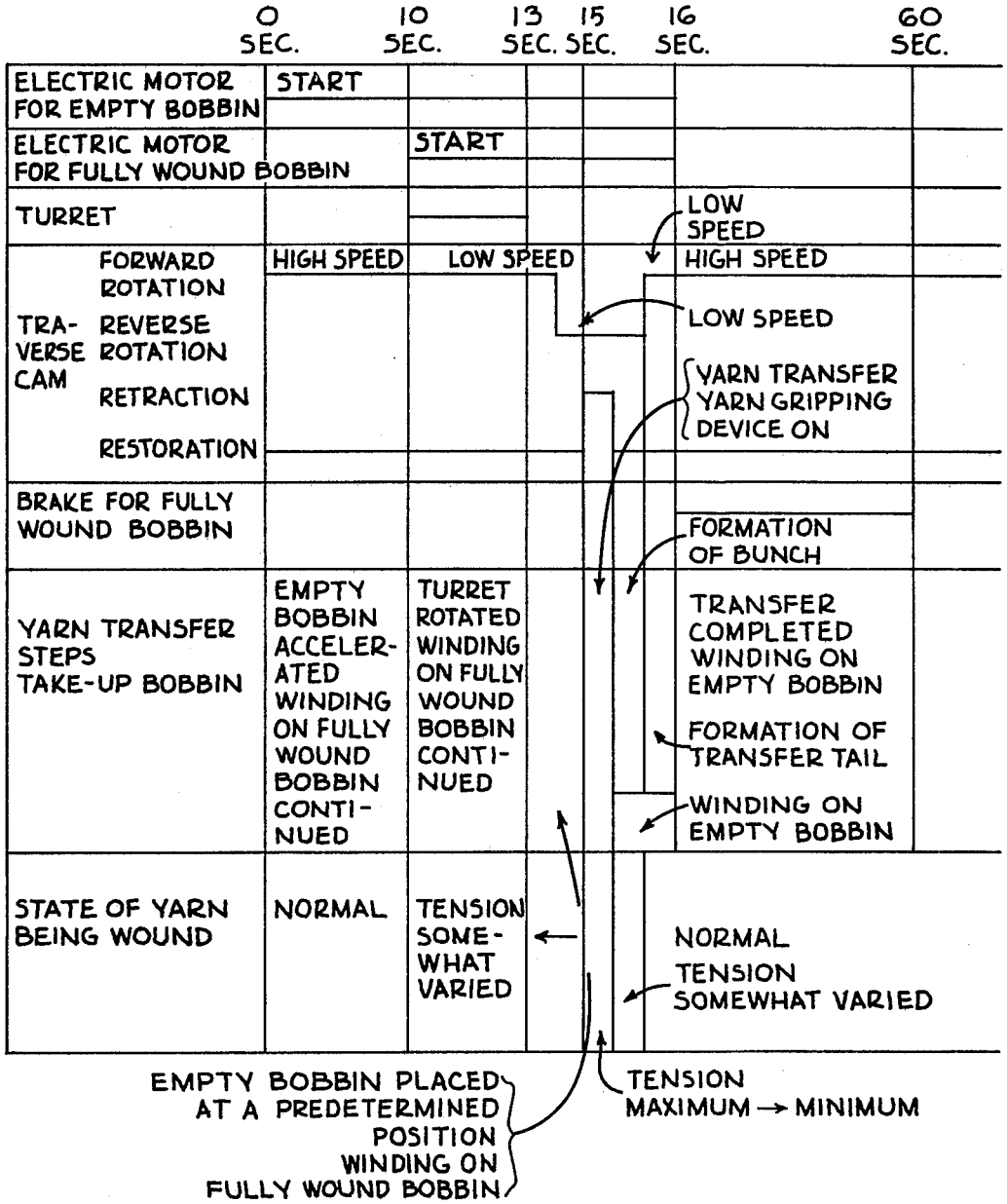
FIG. 8 is a chart showing the sequence of operations of the respective parts of the automatic winder and of the states of the yarn upon automatic transfer.

It is to be noted that the yarn which has been wound on the fully wound bobbin is cut by means of a cutter associated with the yarn gripping device 16 provided at an end of the empty bobbin immediately after the yarn has contacted with the yarn gripping device 16. The drive roll 1 makes pressure contact with the empty bobbin 15 concurrently with the switching of the traverse speed to a high speed, and at the same time the electric motors 12 coupled to the respective bobbin holders 10 and 10' are switched off. The empty bobbin 15 is subjected to frictional drive by means of the drive roll 1 and carries out winding of the conventional surface drive system. The above-mentioned respective operations are carried out continuously and automatically in serveral seconds, and thus the yarn transfer is completed. With regard to the traverse cam roll 2, when the traverse guide 3 is introduced into the fixed groove *a* during reverse rotation and when the traverse guide 3 shifts from the fixed groove *a* to the introductory groove *b* during forward rotation, it is necessary to prevent collision and maze of the traverse guide 3 at a branch portion of the groove, and to that end a groove switch system, for example, as shown in FIGS. 6 and 7 is favorable. In these figures, a fixed groove *a* and an introductory groove *b* are provided on a traverse cam roll 2. Reference numeral 23 designates a switch element that is rockable about a pin 24 in the confluence of the grooves *a* and *b*, and said switch element 23 is normally urged by a spring 25 so as to contact with one side of the groove *a* and to open a route for the groove *b*. Reference numeral 26 designates a part of the traverse guide 3, which takes a boat shape that is freely slidable along the traverse cam groove when fitted therein. Assuming now that the traverse cam roll 2 has been rotated reversely, then the boat-shaped piece 26 enters from the normal cam groove into the introductory groove *b*, and then led to the fixed groove *a* via the confluence. The boat-shaped piece 26 led into the fixed groove *a* is passing through the fixed groove *a* during the reverse rotation of the traverse cam roll 2, and upon passing through the confluence it pushes out the groove switch element 23 against the pressing force of the spring 25 to pass therealong as shown in FIG. 6. On the other hand, when the traverse cam roll 2 has been switched to a forward rotation and the boat-shaped piece 26 passes through the confluence, the piece 26 is naturally led into the introductory groove *b* as shown in FIG. 7 and never returns to the fixed groove *a*, because the groove switch element 23 is normally urged against one side of the fixed groove *a*. Since the above-described switching operations are conducted under a low speed rotating condition of the traverse cam roll 2 (for example, at 240 rpm), both the boat-shaped piece 26 and the groove switch element 23 are subjected to small impact forces, there occurs no faulty operation at all, and there remains no problem with respect to the life of the apparatus. Is is to be noted that arrows X in FIGS. 6 and 7 show the direction of rotation of the traverse cam roll 2, while arrows Y in FIGS. 6 and 7 show the direction of movement of the boat-shaped piece 26 which runs relative to the traverse cam roll 2. Diagrammatically illustrating the sequence of operations of the respective parts and the states of a yarn being wound upon automatic yarn transfer with respect to the above-described embodiment, the table in FIG. 8 is obtained.

As described in detail above, according to the present invention, upon transfer of a yarn, a traverse guide is temporarily stopped at a predetermined position by reversely rotating a traverse cam roll at a low speed, a yarn 18 is shifted to a yarn gripping device by actuating a pneumatic cylinder to make said device carry out gripping and cutting of the yarn, then bunch winding is performed on an empty bobbin in response to restoring operation of the pneumatic cylinder, and after a necessary amount of bunch has been wound, a transfer tail is formed by forwardly rotating the traverse cam roll at a low speed, and then normal winding is started by increasing a traverse speed to a high speed. According to the prior art methods, a yarn was brought in contact with a yarn gripping device at a speed consisting of a vector sum of a shift speed caused by a low speed traverse and a retraction speed of a pneumatic cylinder and then restored to a home position, so that the yarn gripping condition cannot be completely the same but would vary upon every transfer operation, and therefore, a perfect and reliable yarn transfer could not be realized. However, in the method according to the present invention, the speed at which the yarn 18 is shifted to the yarn gripping device at the end of the bobbin for contacting said device, takes a fixed value that is determined depending upon only the operating speed of the pneumatic cylinder, and with regard to the restoring operation also the speed is fixed, so that the yarn transfer condition becomes completely the same and unreliable transfer caused by mis-gripping or partial gripping of a yarn can be eliminated. Furthermore, when an incompletely captured yarn or a partially gripped yarn begins to be wound on an empty bobbin due to poor balancing of a tension in the yarn and due to fluctuation of the performance of the yarn gripping device, if the operation is continued in that state, then the yarn will immediately float up from the yarn gripping section to be slackened, resulting in elimination of a transfer tail or winding itself around the drive roll, and thus the transfer operation fails. However, according to the present invention, the yarn is immediately wound fastened as a bunch winding, so that influence of the slackened and floating yarn is not transmitted beyond the bunch winding, and therefore, the present invention has an advantage that a transfer tail is rigidly guarded and the transfer operation can be achieved reliably. In addition, although the bunch winding naturally consists of a yarn having changed properties that has been affected by the tension variation upon transfer because the bunch winding is formed during the automatic yarn transfer process, regulation of the amount of this bunch winding by timing of the timer, will make it possible to take up all the changed yarn in the bunch winding and to form the subsequent transfer tail with a normal yarn. Thus there is a great advantage that by cutting away the portion of the bunch winding, the wound package can be made of a good quality of yarn including the transfer tail and the innermost wound layer. It is to be noted that sometimes a bunch winding may be formed partly on the outermost layer of the product package and a yarn having changed properties may be mixed therein, but such portion of yarn could be removed by paying off the yarn portion. According to the present invention, an additional advantage is also provided in that the bunch winding is formed at the position of the fixed groove on the traverse cam roll, automation of the removal of the bunch winding is easy because the position is fixed, and also the length of the transfer tail is constant, resulting in convenience for handling.

It should now be apparent that the transferring a yarn in an automatic winder as described hereinabove, possesses each of the attributes set forth in the specification under the heading "Summary of the Invention" hereinbefore. Because the transferring a yarn in an automatic winder can be modified to some extent without departing from the principles of the invention as they have been outlined and explained in this specification, the present invention should be understood as encompassing all such modifications as are within the spirit and scope of the following claims.

What is claimed:

1. A method for transferring a yarn in an automatic winder of surface driven turret type in which upon transferring a yarn, formation of a transfer bunch and formation of a transfer tail can be achieved without disengaging the yarn from a traverse yarn guide, said method comprising the steps of:

reversely rotating a traverse cam roll at a low speed to bring a traverse guide to a stop at a predetermined position; then shifting said traverse guide jointly with said traverse cam roll to make said yarn contact with a yarn gripping device provided at an end of an empty bobbin or an empty bobbin holder;

winding said yarn around an empty bobbin on said empty bobbin holder after having cut the yarn extending to a previously fully wound adjacent bobbin by means of a cutter associated with said yarn gripping device;

restoring said traverse cam roll to its normal position by reversely performing said shifting, forming a bunch winding at a predetermined position on said empty bobbin;

forming a transfer tail by rotating said traverse cam roll in a normal direction opposite to that of said reversely rotating, but still at a low speed, after said bunch winding has been formed, to displace said traverse guide at a low speed from said predetermined position to a normal traverse movement region; and switching the speed of said traverse cam roll to a higher speed and pressing said empty bobbin against a drive roll to carry out surface drive type of winding when said traverse guide has come to said normal traverse movement region.

2. In a turret type automatic winder for winding yarn on bobbins on a succession of bobbin holders to fill each bobbin and transfer to winding on the respective next bobbin, the winder having:

a turret;

means mounting the turret for indexing;

a plurality of bobbin holders projecting from the turret;

a drive roll mounted beside the turret for rotation in driving relation with the respective one of said bobbin holders nearest the drive roll;

a traverse yarn guide for guiding a feed of yarn onto a bobbin on the bobbin holder being rotated by the drive roll;

means associated with each bobbin holder for gripping the yarn at the initiation of winding onto the bobbin thereon;

a traverse cam roll for traversing the traverse yarn guide;

means for rotating the traverse cam roll to traverse the traverse yarn guide;

a cutter associated with the yarn gripping device for cutting the yarn extending between a bobbin which has become fully wound and a next-to-be-wound empty bobbin, once the yarn has been gripped by yarn gripping means associated with the bobbin holder that is holding said next-to-be-wound empty bobbin;

the provision of means for forming a transfer bunch and a transfer tail when transferring from winding yarn on a bobbin which as become fully wound, to a next-to-be-wound empty bobbin on one of said bobbin holders, comprising:

means for reversely rotating the traverse cam roll at low speed to bring the traverse guide to a stop at a predetermined position;

means for shifting the traverse guide jointly with the traverse cam roll in one direction along the longitudinal axes thereof to make the yarn contact said yarn gripping device, and for then shifting the traverse cam roll longitudinally back to a normal position to form a bunch winding at a predetermined position on the empty bobbin;

means for rotating the traverse cam roll in a normal direction at low speed, after the bunch winding has been formed, to displace the traverse guide at a low speed from said predetermined position, to a normal traverse movement region;

and means for switching the speed of rotation of the traverse cam roll to a higher speed and for then pressing the drive roll against the empty bobbin to carry out surface drive winding when the traverse guide has come to said normal traverse movement region.

* * * * *